United States Patent [19]

Couderchon

[11] Patent Number: 4,950,335

[45] Date of Patent: Aug. 21, 1990

[54] PROCESS FOR PRODUCING ARTICLES FOR MAGNETIC USE

[75] Inventor: Georges Couderchon, Sauvighy-les-Bois, France

[73] Assignee: Imphy S. A., Paris, France

[21] Appl. No.: 198,794

[22] Filed: May 25, 1988

[30] Foreign Application Priority Data

May 25, 1987 [FR] France ..... 87 07343

[51] Int. Cl.[5] ..... C21D 1/04

[52] U.S. Cl. ..... 148/102; 148/103; 148/108

[58] Field of Search ..... 148/102, 103, 108

[56] References Cited

U.S. PATENT DOCUMENTS

| | | | |
|---|---|---|---|
| 4,093,477 | 6/1978 | Iwata et al. | 148/103 |
| 4,194,932 | 3/1980 | Iwata | 148/102 |
| 4,311,537 | 1/1982 | Chin et al. | 148/108 |

FOREIGN PATENT DOCUMENTS

| | | | |
|---|---|---|---|
| 692166 | 6/1967 | Belgium . | |
| 1226128 | 5/1955 | Fed. Rep. of Germany . | |
| 2746785 | 4/1979 | Fed. Rep. of Germany . | |
| 3247286 | 6/1983 | Fed. Rep. of Germany | 148/103 |
| 1075890 | 10/1954 | France . | |
| 2330474 | 3/1977 | France . | |
| 2334755 | 7/1977 | France . | |

OTHER PUBLICATIONS

Jin, S., et al., "Low Cobalt Cr-Co-Fe Magnet Alloys Obtained by Slow Cooling under Magnetic Field", *IEEE Transactions on Magnetics,* vol. MAG. 16, No. 3, May 1980, pp. 526-529.

*Primary Examiner*—John P. Sheehan
*Assistant Examiner*—George Wyszomierski
*Attorney, Agent, or Firm*—Pollock, Vande Sande & Priddy

[57] ABSTRACT

A process and apparatus for producing articles for magnetic use consisting of a metal alloy in the form of a continuous strip (3) from which the articles (33) are cut out, the alloy being subjected to a heat treatment comprising at least one annealing operation carried out in the presence of a magnetic field. The annealing operation is divided into at least two successive phases, respectively a first, initiating phase in the presence of a magnetic field, carried out on the alloy in the form of a continuous strip (3) as it unwinds, and a second phase of ageing carried out on the separated articles (33) obtained from the strip (3) which has undergone the first phase. The invention enables the production of articles, in particular, for the electrotechnical industry.

8 Claims, 1 Drawing Sheet

PROCESS FOR PRODUCING ARTICLES FOR MAGNETIC USE

FIELD OF THE INVENTION

The invention relates to a process and an apparatus for producing metal articles for magnetic use, and also includes the products which are obtained by the process and which serve to produce such articles.

BACKGROUND OF THE INVENTION

It is known that various alloys having specific magnetic properties can be used for the manufacture of articles which, thanks to their magnetic properties, can be used in the electrotechnical or electronics industry, for example for the manufacture of relays, meters, transducers, etc.

In particular, alloys currently used include quaternary alloys based on iron, aluminum, nickel and cobalt which have valuable magnetic properties but which are advantageously replaced in certain cases by ternary alloys based on iron, cobalt, and chromium. Such alloys in fact have the advantage of the capability of being shaped by cutting or punching out the alloy, said alloys being in the form of elongated products such as continuous strips or wires, sheets or bars.

The magnetic properties of the alloys can be adjusted as a function of the requirements by altering, on the one hand, the composition of the alloy and, on the other hand, the heat treatments to which it is subjected. In particular, the Fe-Co-Cr alloys comprising 26 to 32% chromium and 9 to 25% cobalt have the advantage of developing magnetic properties close to those of the quaternary Fe-Al-Ni-Co alloys, and are moreover adapted to be cut and shaped, for example by punching out or forging. For this reason they are called shapeable magnets.

The heat treatments which are capable of developing the desired properties are fairly complicated and comprise different operations for heating, maintaining temperature or cooling at predetermined rates of temperature variation. However, for some time it has been observed that it is valuable to subject the magnetic alloy to an annealing operation carried out, for example, at about 650° C. in the presence of a strong magnetic field greater than 160,000 A/m (2,000 Oe).

This annealing operation in the presence of a magnetic field gives very valuable results but has the disadvantage of requiring the use of an electromagnet or similar device for the production of such an intense magnetic field. For this reason, the apparatus is fairly costly and difficult to use.

SUMMARY OF THE INVENTION

The invention relates to a method for carrying out the annealing in a magnetic field which enables, in particular, the use of an electromagnet to be avoided because the magnetic field used is much weaker than in prior art methods.

In accordance with the invention, the annealing operation is divided into at least two successive phases, including a first, initiating phase in the presence of a magnetic field carried out on the elongated product before cutting out the articles, and a second phase of ageing carried out on the separated articles obtained from the product which has undergone the first phase.

In the case where the elongated product is a continuous strip or wire which is capable of being unrolled from a winding, the first phase is carried out continously by unwinding the strip or wire inside a tubular furnace provided with means for producing a magnetic field preferably constituted by a solenoid supplied with electric current and incorporated in the tubular furnace.

In another embodiment of the invention, which can be applied both to continuous strips or wires and to products in the form of sheets or bars, at least part of the product of a length corresponding to that of the furnace is held stationary in a tubular furnace provided with means for producing a magnetic field for the time required to carry out the first phase of the treatment.

According to another valuable feature, the strip is put under traction during the first phase in the presence of a magnetic field.

In a particularly advantageous manner, the magnetic field applied during the first phase can be less than 80,000 A/m (1,000 Oe).

The invention also includes the apparatus for carrying out the process, comprising a tubular furnace connected to means for producing a magnetic field and means for controlling the passing of the strip of alloy through the furnace.

When the whole operation of treatment and preparation of the articles is carried out at the same place, the apparatus has two separate furnaces, respectively a tubular furnace for carrying out the first phase on the strip which unrolls continuously and a furnace for carrying out the second phase of ageing on the articles which have been cut out, the apparatus for cutting out and, where appropriate, shaping the articles being placed between the two furnaces.

However, it is also possible to separate the two phases of annealing treatment, and the invention includes the product consisting of a continuous strip of alloy which has undergone the first phase of the annealing operation and which is consequently capable of being cut out into separate articles, the latter finally being subjected to the second phase of ageing.

BRIEF DESCRIPTION OF THE DRAWINGS

An embodiment of the invention will now be described with reference to the attached drawings.

DESCRIPTION OF PREFERRED EMBODIMENT

The invention is the result of a study carried out on ternary alloys of iron, chromium and cobalt smelted in a vacuum furnace in which there are carried out successively a carbon deoxidation of a mixture of iron and cobalt, the addition of chromium and then of manganese, grading and top-casting. The ingots obtained undergo several hot transformation operations to produce bars which, after cooling, are peeled. The bars are then hot-rolled to obtain flats or wires which are then subjected to water quenching and, where desired, cold working.

The heat treatment which the alloy undergoes can be defined as a phase transformation leading to the magnetic hardening by spinodal decomposition of the $\alpha$ phase into two phases: $\alpha_1$, which is rich in cobalt and strongly magnetic, and $\alpha_2$, which is rich in chromium and weakly magnetic or not at all magnetic.

To obtain the maximum α-phase, the spinodal decomposition treatment is preferably preceded by a recrystallization treatment of short duration, carried out at about 900°-950° C. The alloy then undergoes an annealing operation at about 600°-650° C., which enables the spinodal decomposition to be carried out. It has been observed that this treatment can be carried out in two phases separated from one another, a fist, initiating phase during which it is advantageous to apply a magnetic field to the alloy, and a phase of ageing which, by contrast, does not require the application of the magnetic field. The first phase enables localized segregation to be carried out, which leads to a periodic variation of the composition, the period of which is controlled with precision to produce precipitates of the $\alpha_1$ phase in the $\alpha_2$ phase, with the phase of ageing enabling as high a separation of concentration as possible to be effected between the phases.

This ageing treatment requires a fairly long period of temperature maintenance, of the order of 10 to 20 hours, at a temperature below the temperature of the first phase treatment, while the latter can be carried out more rapidly.

Furthermore, it has been found that the operations of cutting out and shaping the articles can be carried out after the first phase.

It is thus possible, according to the essential feature of the process, to subject the alloy to the first phase, when it is in the form of a continuous strip, then to cut out the articles and finally to subject the latter to the second phase of ageing.

Figure 1:
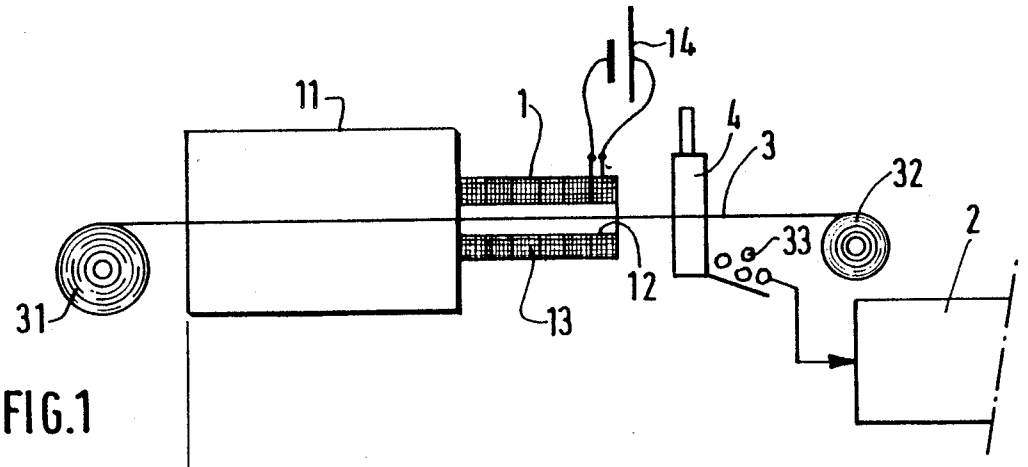
FIG. 1 is a schematic front elevation of, an apparatus for implementing the process according to the invention.

As has been shown schematically in FIG. 1, an apparatus for implementing the process will thus comprise at least two separate heating zones, respectively a first furnace 1 for carrying out the first phase and a second furnace 2 for carrying out the phase of ageing. The alloy is in the form of a strip 3 which is unrolled from a winding 31 to roll around the cylinder 32. The strip 3 thus passes along a direction which is longitudinal through the inside of the furnace 1, which has a tubular shape. The latter is preferably preceded by a furnace 11, inside which the recrystallization treatment is carried out at approximately 950° C.

At the output side of the furnace 1, there is placed a cutting-out device 4 which enables separate articles 33 of the desired shape to be obtained from the strip 3, and, where appropriate after cooling, these articles are directed toward the furnace 2 to undergo the ageing treatment there.

The tubular furnace 11 defines an internal elongated space 12 in which the strip 3 is made to pass. Furthermore, the furnace 1 is provided with means for producing a magnetic field, for example a solenoid 13 connected to an electric current source 14 and incorporated in the wall of the furnace 1 so as to completely surround the central space 12, inside of which there is thus produced the magnetic field by passing the current.

According to an essential advantage of the invention, because the magnetic field is applied to a product of very great length with respect to its thickness and thus having a weak demagnetizing field, it is not necessary to produce a very high magnetizing field in the furnace 1 in order to produce the desired magnetic properties. In practice, it has been found that the necessary magnetizing field, which depends on the desired result and the composition of the alloy, could even be below 80,000 A/m or 1,000 Oe, while until now it was necessary to use a field of at least 160,000 A/m (2,000 Oe) for articles of small dimensions. The use of an electromagnet, which is still expensive, is thus avoided. At the output side of the tubular furnace 1, the strip 3 passes into the cutting-out device 4, and the cutting-out operation does not modify the magnetic structure produced.

Figure 2:
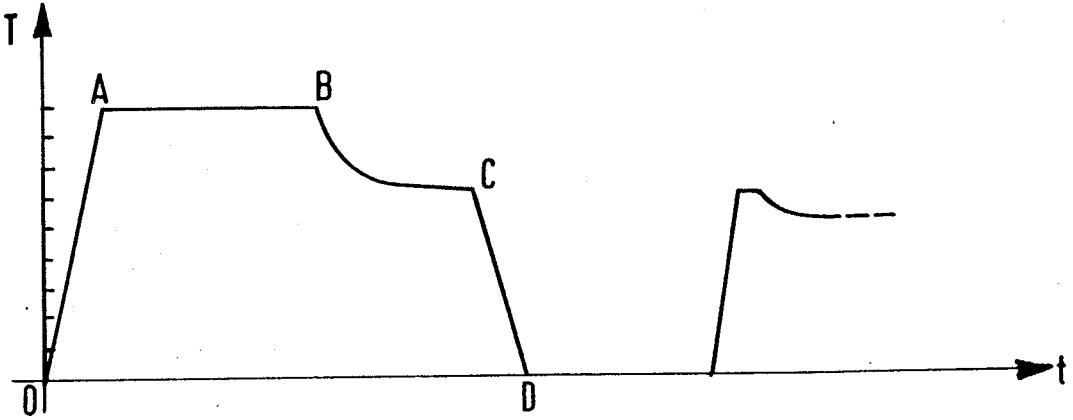
FIG. 2 is a diagram of the heat treatment temperatures.

A temperature cycle is shown, by way of example, in FIG. 2 which is a diagram indicating the treatment temperature as a function of time.

The strip, which is at ambient temperature and unrolls from the winding 31, first passes into the furnace 11, where its temperature increases to approximately 900° C., according to the line OAB. From point B, the strip passes into the tubular furnace 1, in which its temperature decreases to a temperature of the order of 630° C., following the line BC which is thus produced partly in the presence of the magnetic field caused by the solenoid 13. The strip is then cooled rapidly, according to the line CD. Preferably, the articles 33 are cut out in the cold state. The articles 33 are then directed into the furnace 2, where their temperature is maintained for the necessary time, for example for 10 to 20 hours, at a temperature which decreases regularly, preferably from 610° to 520° C.

Given that the strip is preferably subjected, while it is unrolled, first to the recrystallization treatment and then to the first, initiating phase, the duration of maintaining temperature will be controlled by altering the speed of unwinding and as a function of the relative lengths of the tubular furnace 1 and the recrystallization furnace 11, the recrystallization treatment normally being applied for half an hour to an hour.

However, instead of carrying out the treatment continuously in the tubular furnace, the strip could also be advanced at regular intervals, with a part of the strip of the corresponding length remaining stationary in the furnace for the necessary time. Furthermore, the same process could be carried out on an elongated product in the form of separate sheets or bars being fairly long relative to their transverse dimensions, in order that the magnetic treatment might be carried out in a relatively weak field. The sheets or bars would then follow one another into the furnace and remain stationary there for the time necessary for the first phase of treatment, the articles then being cut out to undergo the second phase.

According to the properties which it is desired to produce and the composition of the alloy, the magnetic field created by the solenoid 13 inside the furnace 1 would be between 8,000 and 120,000 A/m (100 to 1,500 Oe), for example 48,000 A/m (600 Oe).

The magnetic structure obtained after the first, initiating phase is permanent, and consequently the cutting-out operation and the second phase of ageing of the treatment can be carried out at some interval after the first phase. It is thus possible first to treat the strip of alloy by subjecting it to the first, initiating phase, possibly preceded by a recrystallization treatment, and to deliver it to the user, who will cut out the articles and subject them to a second phase of ageing, where the latter can be carried out in a fairly simple manner, since it is applied to articles of small size and without a magnetic field.

Simply by way of example, the invention has been implemented in the following manner:

EXAMPLE 1

An ingot composed of 10.2% by weight Co, 28% by weight Cr, 0.5% by weight Mn and the remainder of Fe, plus the usual impurities as a result of the manufacturing processes, is prepared by the conventional methods of vacuum smelting and pouring. The ingot is then hot-rolled at around 1,200°-1,250° C. and cooled rapidly. The hot-rolled product is used to produce a strip 0.75 mm thick by cold rolling.

The cold-rolled strip is then treated while being passed through system of furnaces shown in FIG. 1, such that, in the first furnace 11, the temperature of the strip reaches 950° C. for approximately 30 minutes. The distance between the furnace 11 and the furnace 1 and the thermal insulation are such that, from approximately 700° C., the strip cools by approximately 100° C./h and enters the furnace 1 in which a magnetic field is applied at least 650° C. The temperature of the furnace 1 is regulated to 630° C. and the axial magnetic field is of 600 Oe (48,000 $Am^{-1}$). The length of time over which the strip is unwound in the furnace 1 is at least 30 minutes. On leaving the furnace 1, the strip is cooled rapidly and rolled up.

There are cut out from the strip previously treated articles for carrying out measurements and for use, for example perforated disks used in the meters of cars. These articles are then treated in an ordinary furnace, in which the temperature decreases progressively from 620° C. to 520° C. over 20 hours, for example the furnace 2.

The magnetic properties obtained are the following and illustrate the value of the process.

| Magnetic properties | Hc (Oe) | Br (G) | (BH)(G Oe) max |
|---|---|---|---|
| Treatment without applying field | 410 | 9,100 | $1.5 \times 10^6$ |
| Treatment with application of a field of 600 Oe | 590 | 12,600 | $5.2 \times 10^6$ |

EXAMPLE 2

The same strip is used as in Example 1, but before proceeding to the treatment when passing into the furnaces 11 and 1 this strip is subjected to a treatment at 950° C. for one hour under a hydrogen atmosphere and is cooled rapidly at the end of treatment.

This pretreated strip is then treated by being unwound into the furnaces shown in FIG. 1. In the course of this unwinding treatment, the strip is subjected to uniaxial traction in the direction of its length of approximately 10 kg $mm^{-2}$.

The temperature of the furnace 11 is 700° C. and the strip enters the furnace 1 at 650° C. The temperature of the furnace 1 is regulated to 630° C. and the axial magnetic field is of 800 Oe. The duration of passing into the furnace 1 is 40 minutes. On leaving the furnace 1 the strip is rapidly cooled and rolled up.

Articles are cut out of the strip thus treated under a magnetic field and tension. These articles then undergo the ageing treatment in a conventional furnace where the temperature decreases progressively from 620° C. to 500° C. in 20 hours. A complementary treatment at 500° C. for 24 hours is advantageous. The properties obtained are as follows:

| Hc (Oe) | Br (G) | (BH)(G Oe) max |
|---|---|---|
| 610 | 12,600 | $5.2 \times 10^6$ |

EXAMPLE 3

An alloy of 12% by weight Co, 28% by weight of Cr and 0.5% by weight of Mn, the remainder being of iron and the usual impurities, is smelted in vacuo and poured into ingots. The ingots are then hot-rolled into 5 mm strips and then cold-rolled into strips 1 mm thick.

The strip is then subjected to a treatment at 1,050° C. under a hydrogen atmosphere for half an hour. This treatment ends in rapid cooling.

The strip is then trimmed to the width necessary for the application and cut into 1.5-meter sections. These sections are then grouped into faggots of small diameter and placed in furnace 1.

The temperature of the furnace 1 is rapidly brought to about 700° C., and is then allowed to cool to 620° C. at a rate of approximately 100° C. per hour. From 650° C., the magnetic field of 800 Oe is applied. The temperature is maintained at 620° C. for one hour. At the end of this treatment at 620° C., the faggots of strips are cooled rapidly.

The articles for measurement and use are cut out from the strips and then treated in a furnace, the temperature of which decreases from 620° C. to 520° C. over 20 hours. A complementary treatment of 24 hours at 500° C. further increases the magnetic properties.

The properties obtained as a result of this series of treatments are the following:

| Hc (Oe) | Br (G) | (BH)(G Oe) max |
|---|---|---|
| 650 | 12,400 | $5.3 \times 10^6$ |

The treatment temperatures have been indicated for an alloy comprising only 10% of cobalt, but these could be modified as a function of the properties sought and the composition of the alloy. Moreover, it is possible to carry out more complex heat treatments comprising, in particular, different temperature stages, seperated if desired by more or less rapid cooling phases. In fact, even when the treatment is carried out on the alloy in the form of a strip, the furnaces can be arranged in sequence by separating them by thermally insulated zones to effect the different temperatures desired.

While the term "strip" has been used in the text, the invention also includes the use of any elongated product, such as a continuous wire or sheets or bars, it being possible for the product to be adapted to the shape of the articles in cross-section. Similarly, after cutting out, the latter can undergo various shaping operations, for example by forging.

Furthermore, it could be valuable, by regulating the relative rates of unrolling and rolling up of the strip, or else by means of a device connected to the furnace, to exert a certain tension on the product so as to combine the action of the latter with that of the temperature and the magnetic field. The latter can furthermore be created by different known means, using a direct or alternating current and, by adapting the circuit, the electric current could furthermore produce simultaneously the magnetic field and the heating of the furnace.

What is claimed is:

1. A method of producing articles for magnetic uses comprising the steps of (a) producing a continuous strip or wire consisting of a metal magnetic alloy based on iron, cobalt and chromium;

(b) subjecting said strip to a first, initiating phase of an annealing operation by passing said strip or wire inside a tubular furnace having at least a part provided with means for producing a magnetic field, said strip being subjected inside said tubular furnace to a temperature between 600° C. and 650° C. with presence of a magnetic field which is lower than 80,000 A/m (1000 Oe);

(c) cutting out separate articles of a desired shape from said strip; and (d) subjecting said articles to a second, ageing phase of said annealing operation in a second furnace where said articles are maintained at a temperature decreasing regularly and without magnetic field for a time sufficient to increase the coercivity and energy products thereof.

2. A method according to claim 1, wherein said second, ageing phase is carried out at a temperature which decreases from 600° C. to 500° C.

3. A method as claimed in claim 1, wherein said continuous strip or wire is capable of being unrolled from a winding, and said first, initiating phase is carried out continuously.

4. A method as claimed in claim 1, wherein at least a part of said strip or wire corresponding in length to a length of said tubular furnace is kept stationary during said first initiating phase.

5. A process as claimed in claim 1, wherein said magnetic field is produced by passing electric current in a conductor incorporated in the tubular furnace (1).

6. A process as claimed in claim 1, wherein, during the application of said first, initiating phase, in said magnetic field, said strip or wire is put under tension.

7. A process as claimed in any one of claims 1 to 6, wherein, before being subjected to said first, initiating phase, said strip or wire of alloy is subjected to a recrystallization treatment at a temperature of between 900° and 950° C. for a period of one-half hour to one hour.

8. A product for producing articles (33) for magnetic use, said product being constituted by an elongated metal strip or wire (3) which has undergone a first, initiating phase of the process as claimed in any one of claims 1 to 6, and from which articles (33) are capable of being cut out and subjected to a second, aging phase.

* * * * *